US009948010B2

(12) United States Patent
Brandau

(10) Patent No.: US 9,948,010 B2
(45) Date of Patent: Apr. 17, 2018

(54) METHOD FOR DISH REFLECTOR ILLUMINATION VIA SUB-REFLECTOR ASSEMBLY WITH DIELECTRIC RADIATOR PORTION

(71) Applicant: CommScope Technologies LLC, Hickory, NC (US)

(72) Inventor: Ronald J Brandau, Homer Glen, IL (US)

(73) Assignee: CommScope Technologies LLC, Hickory, NC (US)

( * ) Notice: Subject to any disclaimer, the term of this patent is extended or adjusted under 35 U.S.C. 154(b) by 278 days.

(21) Appl. No.: 14/992,062

(22) Filed: Jan. 11, 2016

(65) Prior Publication Data

US 2016/0126638 A1 May 5, 2016

Related U.S. Application Data

(63) Continuation-in-part of application No. 14/851,311, filed on Sep. 11, 2015, which is a continuation of application No. 13/224,066, filed on Sep. 1, 2011, now abandoned.

(51) Int. Cl.

| | |
|---|---|
| ***H01Q 13/06*** | (2006.01) |
| ***H01Q 19/19*** | (2006.01) |
| ***H01Q 19/13*** | (2006.01) |

(52) U.S. Cl.

CPC ..... *H01Q 19/193* (2013.01); *H01Q 19/134* (2013.01); *H01Q 13/06* (2013.01)

(58) Field of Classification Search

CPC ..... H01Q 13/06; H01Q 19/19; H01Q 19/13

USPC ..... 343/781 CA

See application file for complete search history.

(56) References Cited

U.S. PATENT DOCUMENTS

| | | | |
|---|---|---|---|
| 2,605,416 | A | 7/1952 | Foster |
| 4,673,945 | A | 6/1987 | Syrigos |
| 4,673,947 | A | 6/1987 | Newham |
| 4,963,878 | A | 10/1990 | Kildal |
| 5,959,590 | A | 9/1999 | Sanford et al. |
| 5,973,652 | A | 10/1999 | Sanford et al. |
| 6,020,859 | A | 2/2000 | Kildal |
| 6,107,973 | A | 8/2000 | Knop et al. |
| 6,137,449 | A | 10/2000 | Kildal |
| 6,429,826 | B2 | 8/2002 | Karlsson et al. |
| 6,456,253 | B1 | 9/2002 | Rummeli et al. |
| 6,522,305 | B2 | 2/2003 | Sharman |
| 6,697,027 | B2 | 2/2004 | Mahon |
| 6,724,349 | B1 | 4/2004 | Baird et al. |
| 6,862,000 | B2 | 3/2005 | Desargant et al. |
| 6,919,855 | B2 | 7/2005 | Hills |
| 6,985,120 | B2 | 1/2006 | Lewry et al. |

(Continued)

*Primary Examiner* — Andrea Lindgren Baltzell
(74) *Attorney, Agent, or Firm* — Myers Bigel, P.A.

(57) ABSTRACT

A method for illuminating a dish reflector of a reflector antenna, including providing a waveguide coupled to a vertex of a dish reflector at a proximal end, a sub-reflector supported by a dielectric block coupled to a distal end of the waveguide, the dielectric block provided with a dielectric radiator portion proximate the distal end of the waveguide. An RF signal passing through the waveguide and the dielectric block to reflect from the sub-reflector through the dielectric block and at least partially through the dielectric radiator portion to the dish reflector illuminates the dish reflector with a maximum signal intensity and/or signal intensity angular range that is spaced outward from the vertex area of the dish reflector.

20 Claims, 10 Drawing Sheets

(56) References Cited

U.S. PATENT DOCUMENTS

| | | | |
|---|---|---|---|
| 6,995,727 | B2 | 2/2006 | Tuau et al. |
| 7,907,097 | B2 | 3/2011 | Syed et al. |
| 2002/0008670 | A1 | 1/2002 | Sharman |
| 2005/0007288 | A1 | 1/2005 | Tuau |
| 2005/0017916 | A1 | 1/2005 | Lewry et al. |
| 2005/0062663 | A1 | 3/2005 | Hills |
| 2009/0021442 | A1 | 1/2009 | Syed |

METHOD FOR DISH REFLECTOR ILLUMINATION VIA SUB-REFLECTOR ASSEMBLY WITH DIELECTRIC RADIATOR PORTION

BACKGROUND

Field of the Invention

This invention relates to a microwave dual reflector antenna. More particularly, the invention provides a low cost self supported feed cone radiator for such antennas enabling improved control of the signal radiation pattern characteristics.

Description of Related Art

Dual reflector antennas employing self-supported feed direct a signal incident on the main reflector onto a sub-reflector mounted adjacent to the focal region of the main reflector, which in turn directs the signal into a waveguide transmission line typically via a feed horn or aperture to the first stage of a receiver. When the dual reflector antenna is used to transmit a signal, the signals travel from the last stage of the transmitter system, via the waveguide, to the feed aperture, sub-reflector, and main reflector to free space.

The electrical performance of a reflector antenna is typically characterized by its gain, radiation pattern, cross-polarization and return loss performance—efficient gain, radiation pattern and cross-polarization characteristics are essential for efficient microwave link planning and coordination, whilst a good return loss is necessary for efficient radio operation.

These principal characteristics are determined by a feed system designed in conjunction with the main reflector profile.

Deep dish reflectors are reflector dishes wherein the ratio of the reflector focal length (F) to reflector diameter (D) is made less than or equal to 0.25 (as opposed to an F/D of 0.35 typically found in more conventional dish designs). Such designs can achieve improved radiation pattern characteristics without the need for a separate shroud assembly when used with a carefully designed feed system which provides controlled dish illumination, particularly toward the edge of the dish.

An example of a dielectric cone feed sub-reflector configured for use with a deep dish reflector is disclosed in commonly owned U.S. Pat. No. 6,919,855, titled "Tuned Perturbation Cone Feed for Reflector Antenna" issued Jul. 19, 2005 to Hills, hereby incorporated by reference in its entirety. U.S. Pat. No. 6,919,855 utilizes a generally conical dielectric block cone feed with a sub-reflector surface and a leading cone surface having a plurality of downward angled non-periodic perturbations concentric about a longitudinal axis of the dielectric block. The cone feed and sub-reflector dimensions are minimized where possible, to prevent blockage of the signal path from the reflector dish to free space. Although a significant improvement over prior designs, such configurations have signal patterns in which the sub-reflector edge and distal edge of the feed boom radiate a portion of the signal broadly across the reflector dish surface, including areas proximate the reflector dish periphery and/or a shadow area of the sub-reflector where secondary reflections with the feed boom and/or sub-reflector may be generated, degrading electrical performance. Further, the plurality of angled features and/or steps in the dielectric block requires complex manufacturing procedures which increase the overall manufacturing cost.

Therefore it is the object of the invention to provide an apparatus that overcomes limitations in the prior art, and in so doing present a solution that allows such a feed design to provide reflector antenna characteristics which meet the most stringent electrical specifications over the entire operating band used for a typical microwave communication link.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

The inventor has recognized that improvements in radiation pattern control and thus overall reflector antenna performance may be realized by reducing or minimizing the electrical effect of the feed boom end and sub-reflector overspill upon the radiation pattern of conventional dielectric cone sub-reflector assemblies, by providing reflector dish illumination that is spaced away from the vertex area of the reflector dish.

Figure 1:
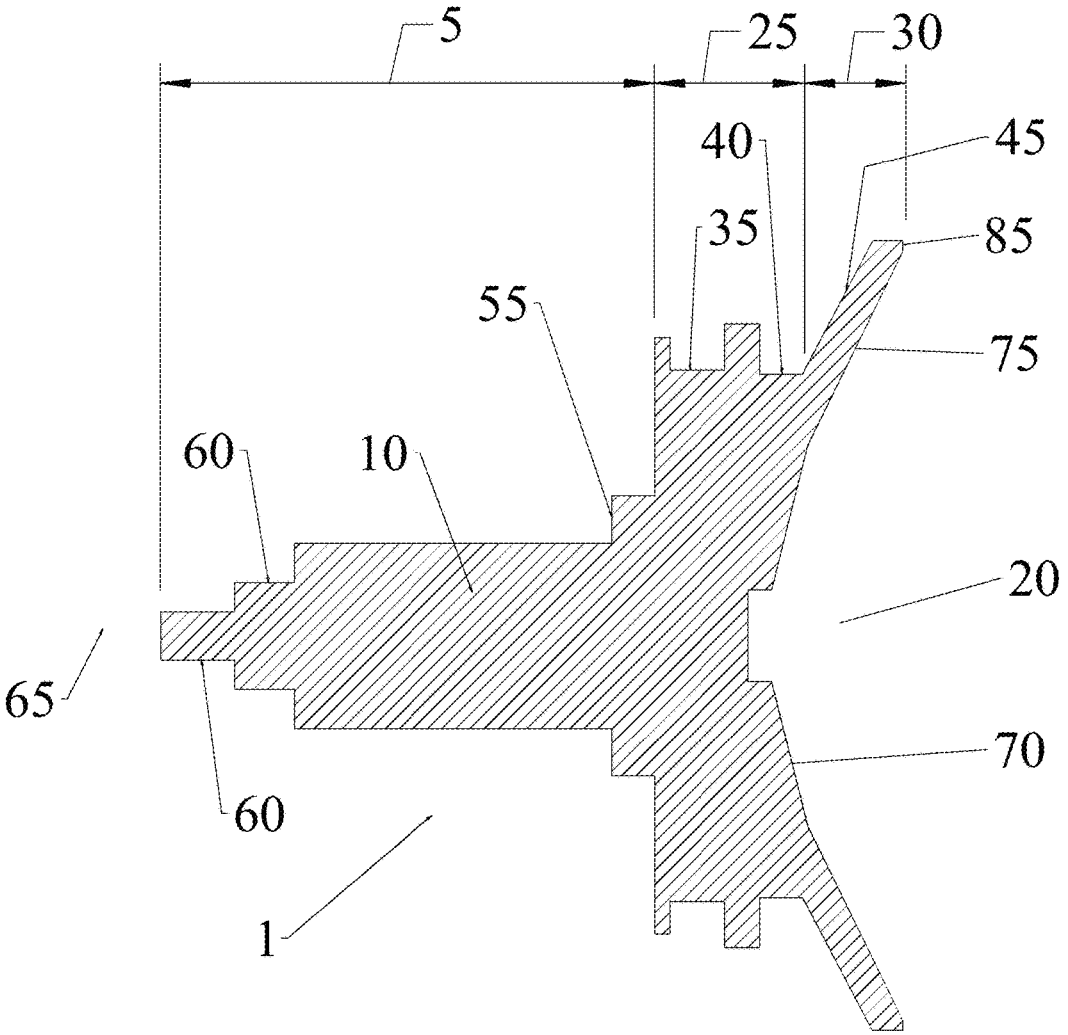
FIG. 1 is a schematic cut-away side view of an exemplary controlled illumination dielectric cone sub-reflector assembly.
Figure 2:
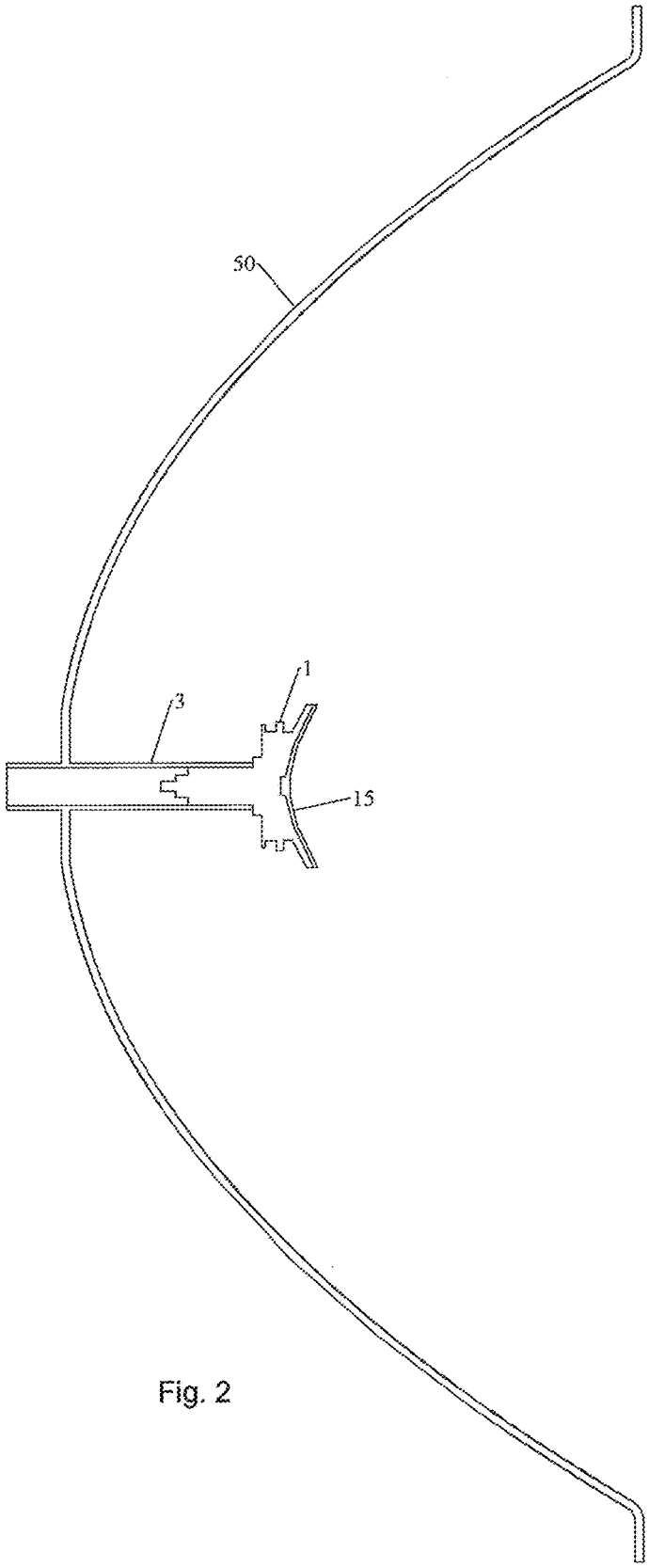
FIG. 2 is a schematic cut-away side view of the sub-reflector assembly of FIG. 4, mounted within a 0.167 F/D deep dish reflector antenna.
Figure 4:
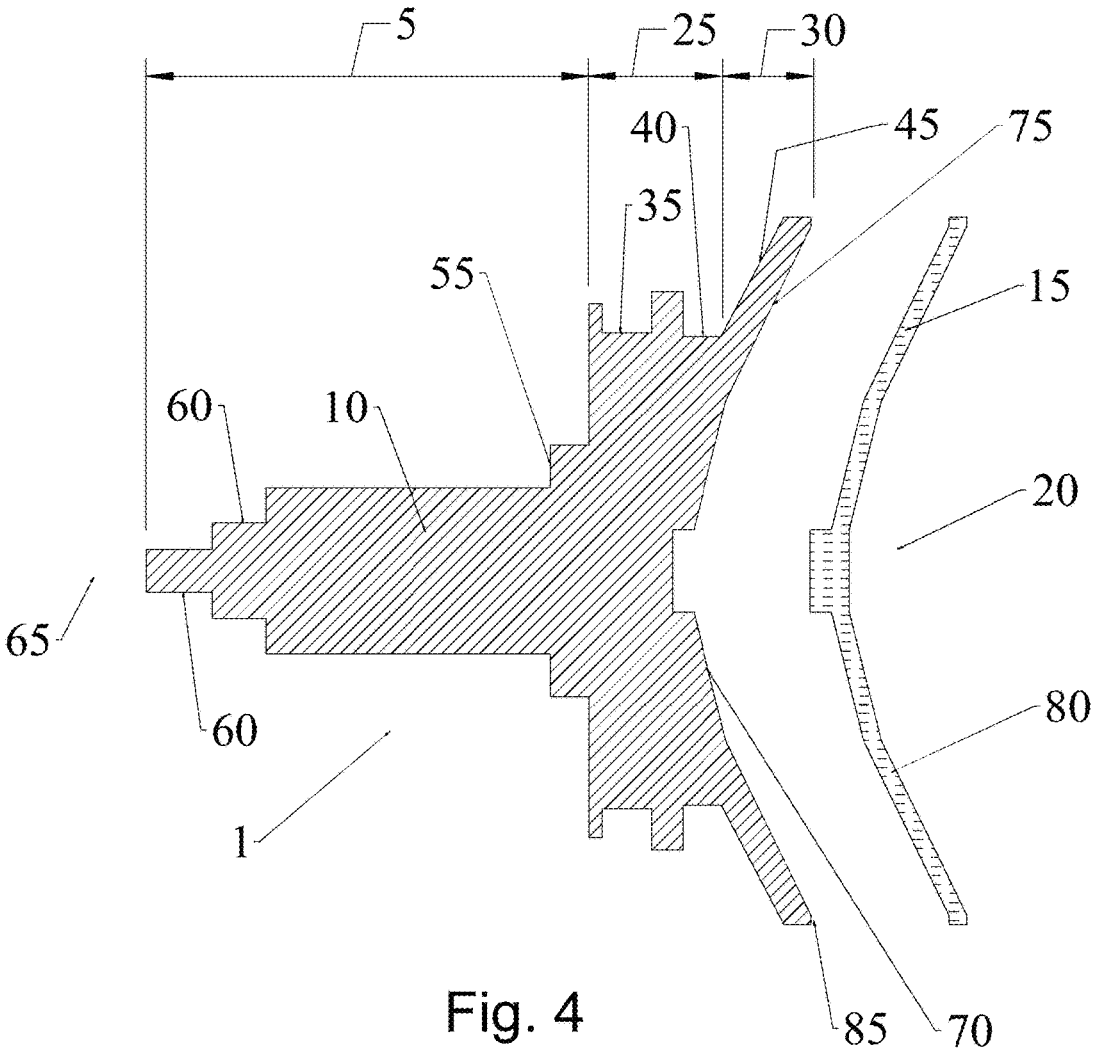
FIG. 4 is an exploded schematic cut-away side view of the sub-reflector assembly of FIG. 1, illustrated with a separate metal disc type sub-reflector.
Figure 5:
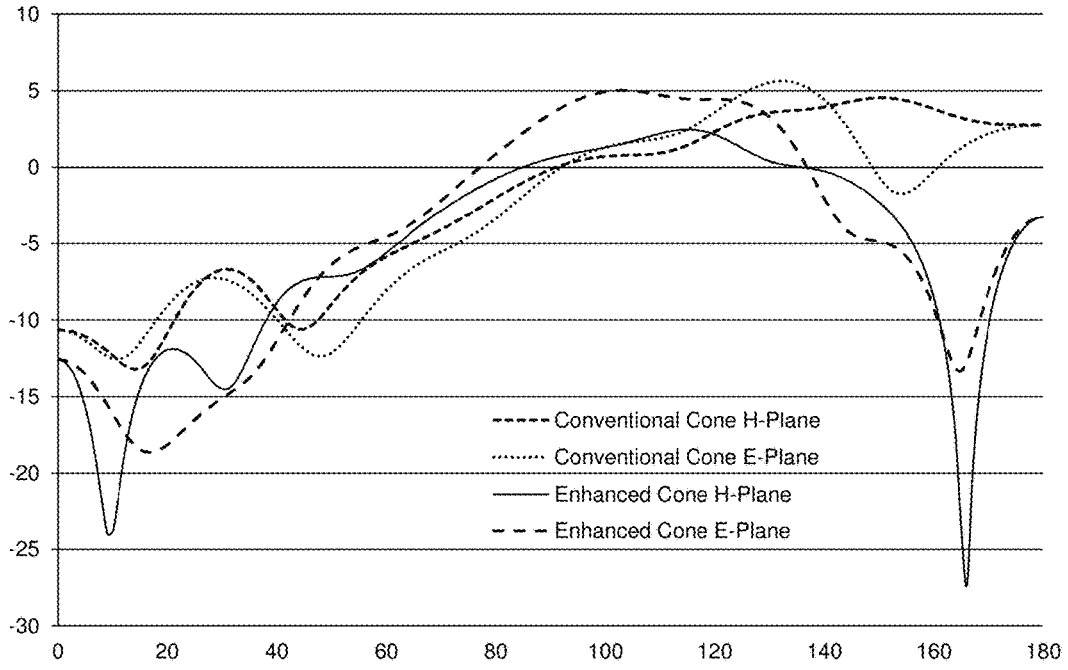
FIG. 5 is an E & H plane primary radiation amplitude pattern modeled comparison chart (180' is boresight) for the sub-reflector assemblies of FIG. 1 and FIG. 3 operating at 22.4 Ghz, wherein the dot line is FIG. 3 E plane, short dash line is FIG. 3 H Plane, long dash line is FIG. 1 E plane and the solid line is FIG. 1 H plane.

As shown in FIGS. 1, 2 and 4, a cone radiator sub-reflector assembly 1 is configured to couple with the end of a feed boom waveguide 3 at a waveguide transition portion 5 of a unitary dielectric block 10 which supports a sub-reflector 15 at the distal end 20. The sub-reflector assembly 1 utilizes an enlarged sub-reflector diameter for reduction of sub-reflector spill-over. The sub-reflector 15 may be dimensioned, for example, with a diameter that is 2.5 wavelengths or more of a desired operating frequency, such as the mid-band frequency of a desired microwave frequency band. The exemplary embodiment is dimensioned with a 39.34 mm outer diameter and a minimum dielectric radiator portion diameter of 26.08 mm, which at a desired operating frequency in the 22.4 Ghz microwave band corresponds to 2.94 and 1.95 wavelengths, respectively.

Figure 3:
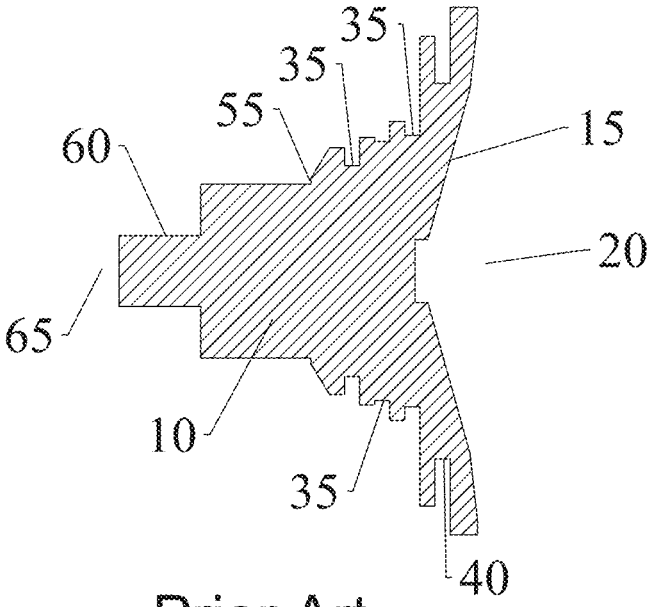
Prior Art Fig. 3
FIG. 3 is a schematic cut-away side view of a prior art dielectric cone sub-reflector assembly.

A generally cylindrical dielectric radiator portion 25 situated between the waveguide transition portion 5 and a sub-reflector support portion 30 of the dielectric block 10 is also increased in size. The dielectric radiator portion 25 may be dimensioned, for example, with a minimum diameter of at least ⅗ of the sub-reflector diameter. The enlarged dielectric radiator portion 25 is operative to pull signal energy outward from the end of the waveguide 3, thus minimizing the diffraction at this area observed in conventional dielectric cone sub-reflector configurations, for example as shown in FIG. 3. The conventional dielectric cone has an outer diameter of 28 mm and a minimum diameter in a "radiator region" of 11.2 mm, which at a desired operating frequency in the 22.4 Ghz microwave band corresponds to corresponding to 2.09 and 0.84 wavelengths, respectively. In contrast to the generally cylindrical dielectric radiator portion 25 of the exemplary dielectric cone of FIGS. 1, 2 and 4, the conventional dielectric cone has a generally conical progressively increasing diameter characteristic typical of the prior mindset that the dielectric block's only purpose was to support the sub reflector while attempting to minimize surface currents via choke grooves provided along the outer surface.

A plurality of corrugations are provided along the outer diameter of the dielectric radiator portion as radial inward grooves 35. The radial inward grooves 35 may be provided perpendicular to a longitudinal axis of the dielectric block. In the present embodiment, the plurality of grooves is two grooves 35. A distal groove 40 of the dielectric radiator portion 25 may be provided with an angled distal sidewall 45 that initiates the sub-reflector support portion 30. The distal sidewall 45 may be generally parallel to a longitudinally adjacent portion of the distal end 20, that is, the distal sidewall 45 may form a conical surface parallel to the longitudinally adjacent conical surface of the distal end 20 supporting the sub-reflector 15, so that a dielectric thickness along this surface is constant with respect to the sub-reflector 45.

The waveguide transition portion 5 of the sub-reflector assembly 1 may be adapted to match a desired circular waveguide internal diameter so that the sub-reflector assembly 1 may be fitted into and retained by the waveguide 3 that supports the sub-reflector assembly 1 within the dish reflector 50 of the reflector antenna proximate a focal point of the dish reflector 50. The waveguide transition portion 5 may insert into the waveguide 3 until the end of the waveguide abuts a shoulder 55 of the waveguide transition portion 5.

The shoulder 55 may be dimensioned to space the dielectric radiator portion 25 away from the waveguide end and/or to further position the periphery of the distal end 20 (the farthest longitudinal distance of the sub-reflector signal surface from the waveguide end) at least 0.75 wavelengths of the desired operating frequency. The exemplary embodiment is dimensioned with a 14.48 mm longitudinal length, which at a desired operating frequency in the 22.4 Ghz microwave band corresponds to 1.08 wavelengths. For comparison, the conventional dielectric cone of FIG. 3 is dimensioned with 8.83 mm longitudinal length or 0.66 wavelengths at the same desired operating frequency.

One or more step(s) 60 at the proximal end 65 of the waveguide transition portion 5 and/or one or more groove(s) may be used for impedance matching purposes between the waveguide 3 and the dielectric material of the dielectric block 10.

The sub-reflector 15 is demonstrated with a proximal conical surface 70 which transitions to a distal conical surface 75, the distal conical surface 75 provided with a lower angle with respect to a longitudinal axis of the sub-reflector assembly 1 than the proximal conical surface 70.

As best shown in FIG. 1, the sub-reflector 15 may be formed by applying a metallic deposition, film, sheet or other RF reflective coating to the distal end of the dielectric block 10. Alternatively, as shown in FIGS. 2 and 4, the sub-reflector 15 may be formed separately, for example as a metal disk 80 which seats upon the distal end of the dielectric block 10.

Figure 6:
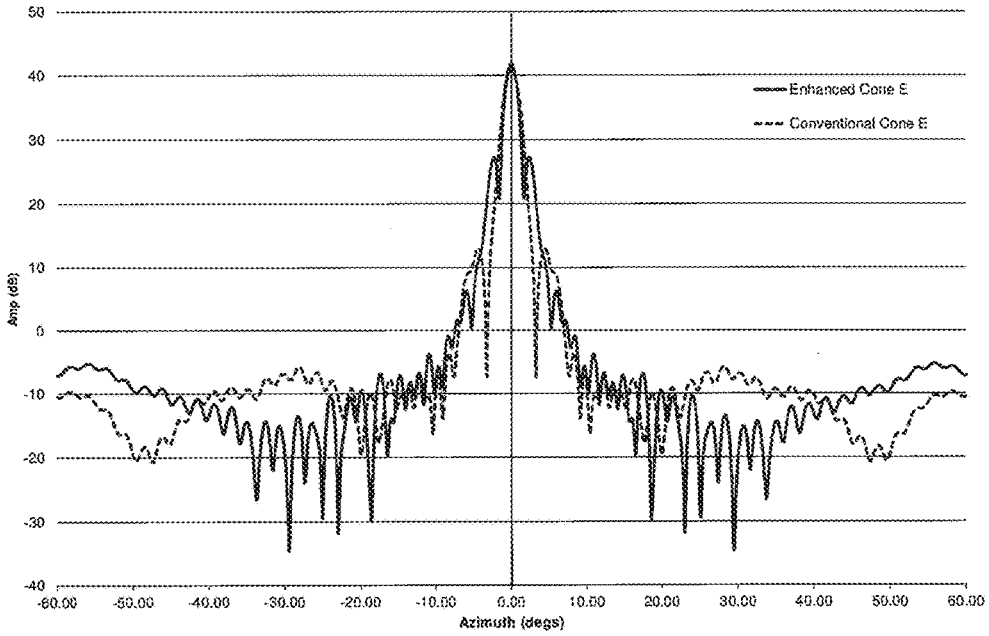
FIG. 6 is an E plane radiation pattern model comparison chart for the dielectric cone feeds of FIG. 1 and FIG. 3 mounted within a 0.167 F/D reflector dish according to FIG. 2.
Figure 7:
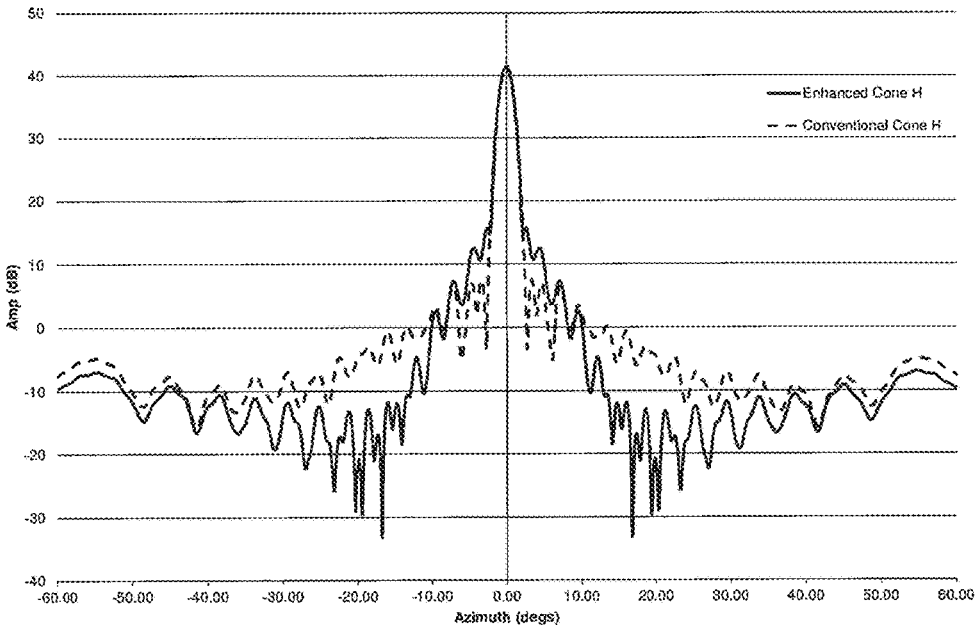
FIG. 7 is an H plane radiation pattern model comparison chart for the dielectric cone feeds of FIG. 1 and FIG. 3 mounted within a 0.167 F/D reflector dish according to FIG. 2.

When applied with an 0.167 F/D deep dish reflector 50, the sub-reflector assembly 1 provides surprising improvements in the signal pattern, particularly in the region between 10 and 45 degrees. For example, as shown in FIGS. 6 and 7, radiation in both the E & H planes is significantly reduced in the 10 to 45 degree region.

Figure 8:
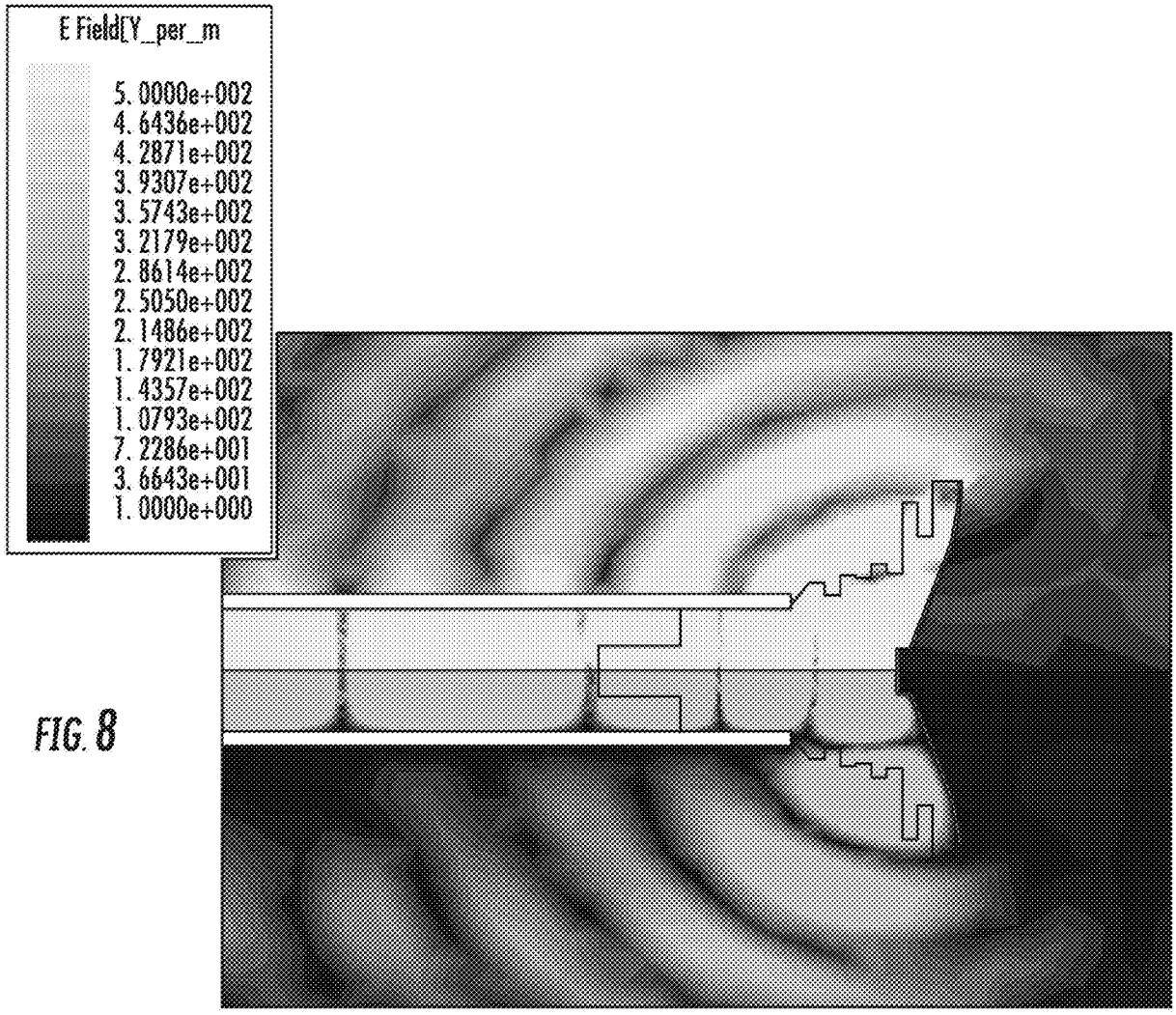
FIG. 8 is an E (top half) & H (bottom half) plane energy field distribution model for the sub-reflector assembly of FIG. 3 (model is a planar rendering of quarter symmetry).

FIG. 8 demonstrates a time slice radiation energy plot simulation of a conventional sub-reflector assembly, showing the broad angular spread of the radiation pattern towards the reflector dish surface and in particular the diffraction effect of the waveguide end drawing the signal energy back along the boresight toward the vertex area which necessitates the limiting of the sub-reflector diameter to prevent significant signal blockage and/or introduction of electrical performance degrading secondary reflections/interference.

Figure 9:
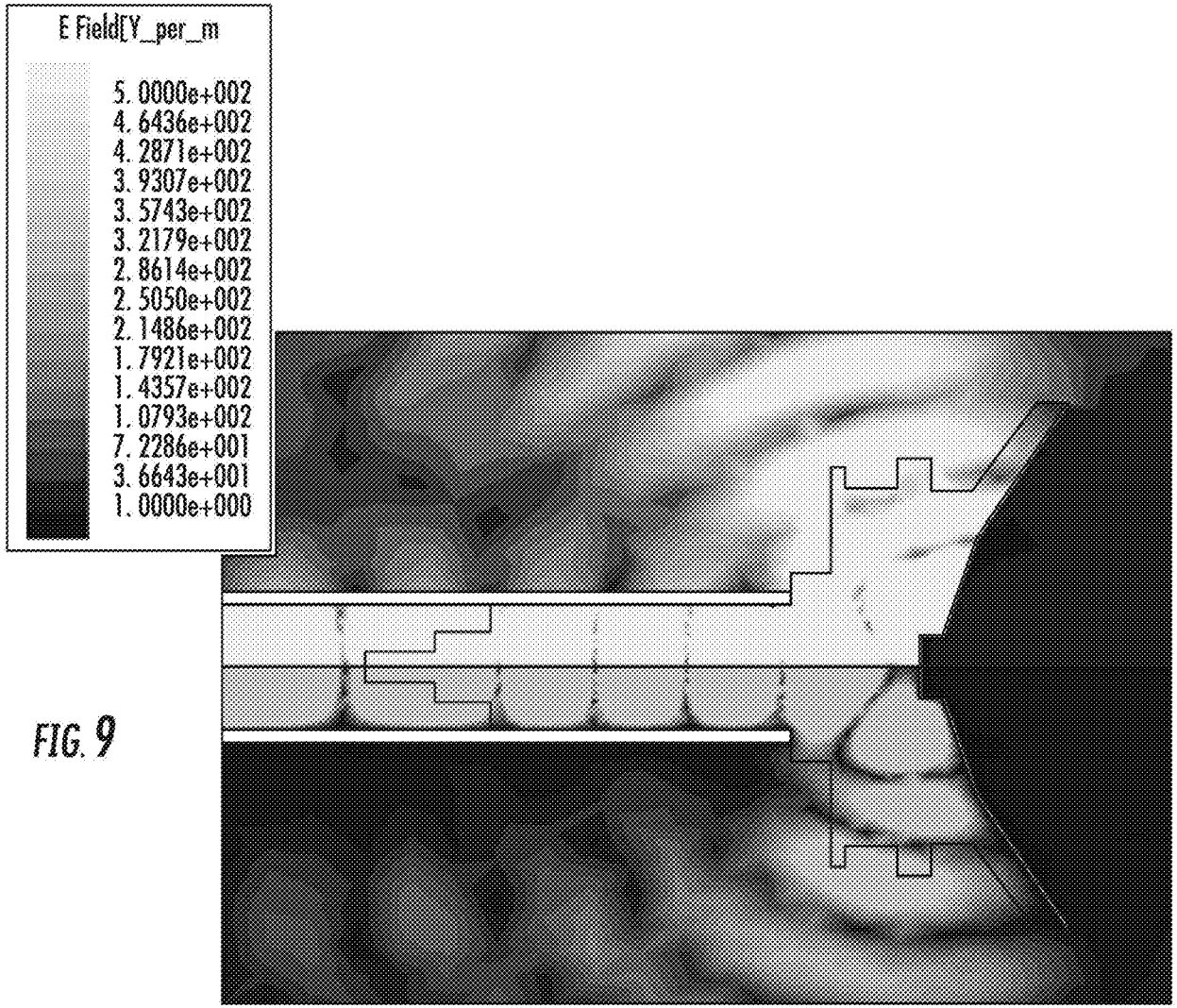
FIG. 9 is an E (top half) & H (bottom half) plane primary energy field distribution model for the sub-reflector assembly of FIG. 1 (model is a planar rendering of quarter symmetry).

In contrast, FIG. 9 shows a radiation energy plot simulation of the exemplary controlled illumination cone radiator sub-reflector assembly 1 demonstrating the controlled illumination of the dish reflector 50 by the sub-reflector assembly 1 as the radiation pattern is directed primarily towards an area of the dish reflector 50 spaced away both from the sub-reflector shadow area and the periphery of the dish reflector 50.

The illumination of the dish reflector surface by the exemplary controlled illumination cone radiator sub-reflector assembly 1 utilizing the dielectric radiator portion 25 results in dish reflector illumination wherein both the maximum signal intensity and the majority of dish reflector illumination, in general, are shifted outward along the dish reflector surface, away from the vertex area.

Figure 10:
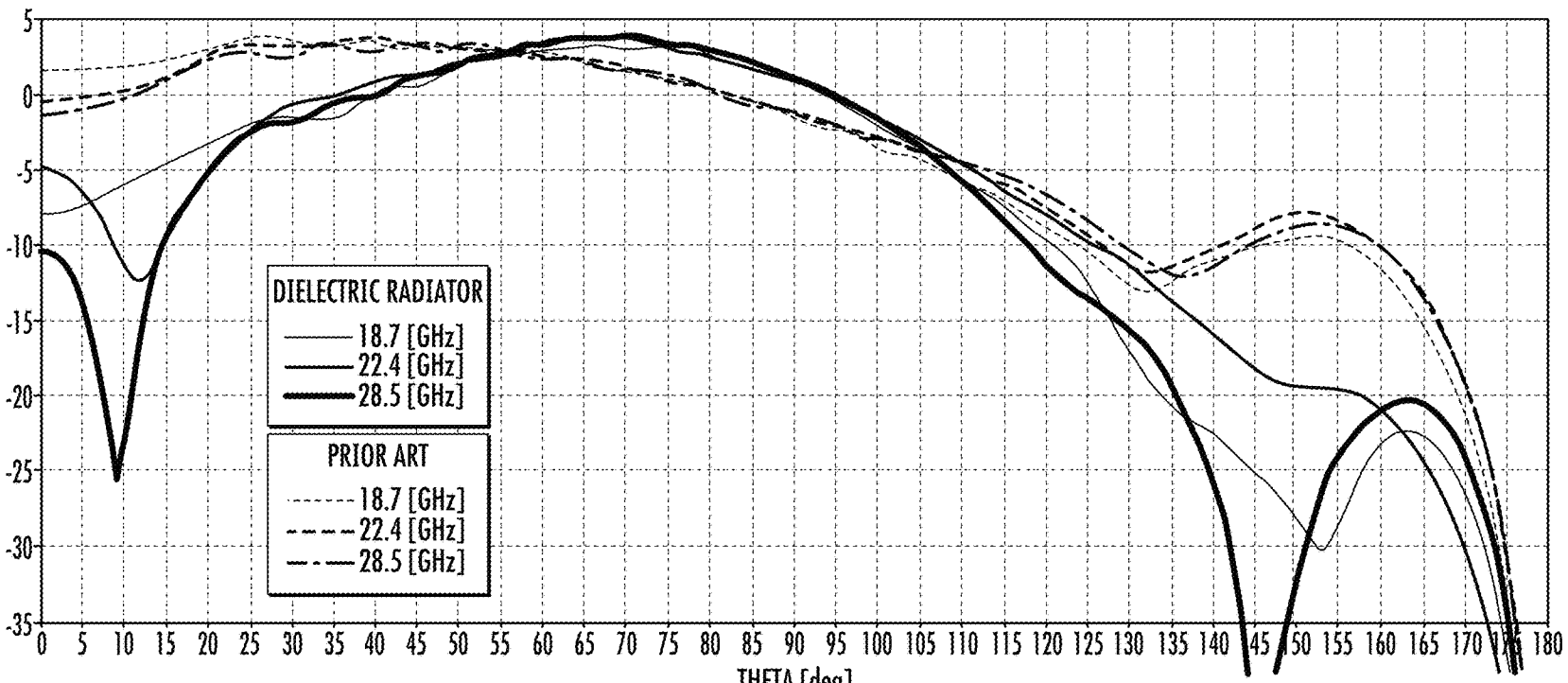
FIG. 10 is a 45 degree plane primary radiation pattern for 0.168 F\D dish reflector illumination amplitude versus angle from the focal point modeled comparison chart for sub-reflector and dish assemblies of FIGS. 1 and 3 configured for and operating at 18.7, 22.4 and 28.5 GHz. The varied dot/dashed lines are the prior art sub-reflector assembly and the varied width solid lines are the exemplary sub-reflector assembly, wherein 0' is the dish reflector vertex.
Figure 11:
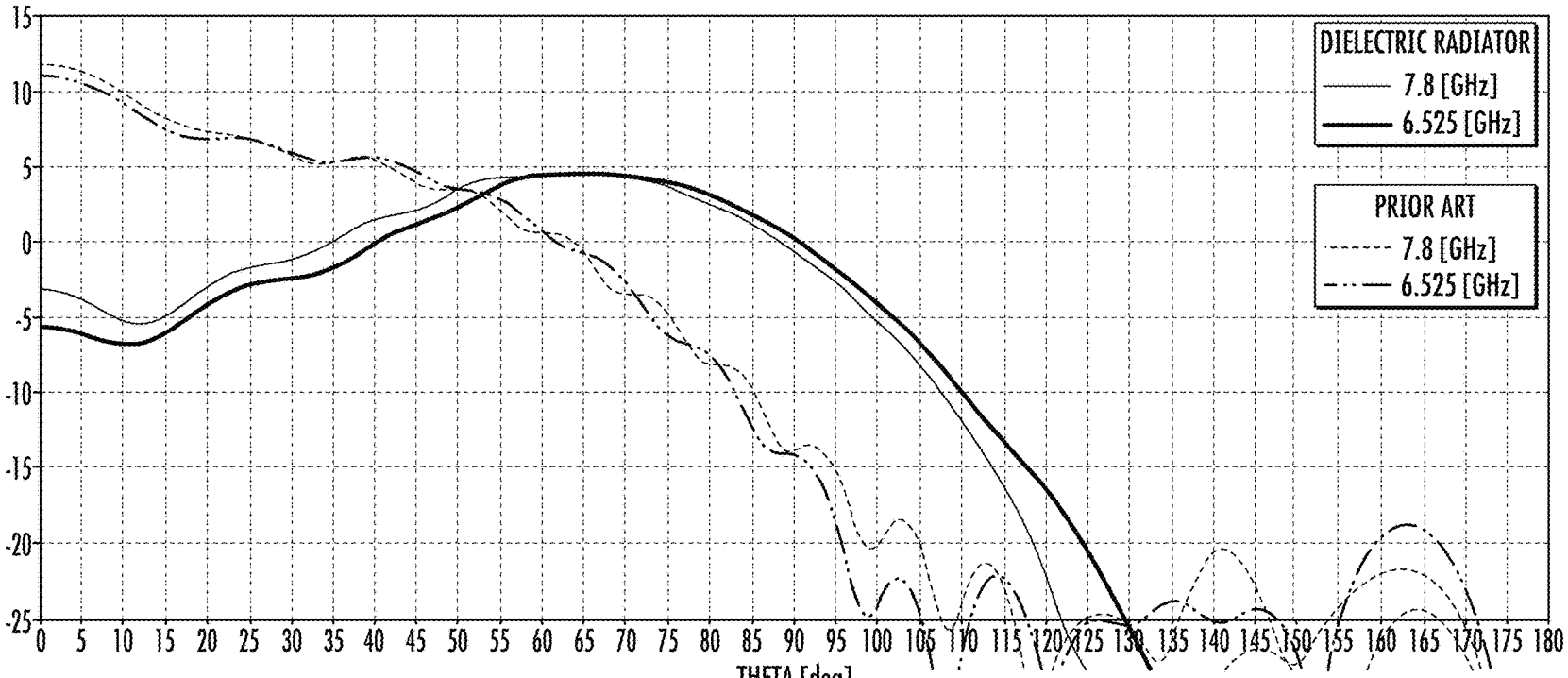
FIG. 11 is a 45 degree plane primary radiation pattern for 0.25 F\D dish reflector illumination amplitude versus angle from the focal point modeled comparison chart for sub-reflector and dish assemblies of FIGS. 1 and 3 configured for and operating at 6.525 and 7.8 GHz. The varied dot/dashed lines are the prior art sub-reflector assembly and the varied width solid lines are the exemplary sub-reflector assembly, wherein 0' is the dish reflector vertex.

As shown by the dish reflector illumination amplitude charts of FIGS. 10 and 11, the illumination of the dish reflector, identified with respect to an angle between the longitudinal axis of the waveguide and a line between the focal point of the dish reflector and the dish reflector surface is not only shifted outward from the vertex area, but illumination of the vertex area is reduced to surprisingly low levels resulting in an angular range of primary dish reflector illumination, instead of vertex area illumination as the primary dish reflector illumination, as shown with respect to the prior art sub reflector assemblies without a dielectric radiator portion 25.

For ease of demonstration, FIGS. 10 and 11 are provided in 45 degree plane format, an averaging of the E and H plane performance that is thus representative of an annular illumination pattern of the dish reflector, at the indicated illumination intensity, over 360 degrees around the dish reflector surface at each indicated angle from the vertex area (0 degrees) to the dish reflector periphery (180 degrees).

One skilled in the art will appreciate that in the exemplary embodiments utilizing the dielectric radiator portion 25 the resulting illumination pattern forms an annular region of illumination intensity coaxial with the longitudinal axis of the waveguide, that is—in contrast with the prior art, there is minimal signal illumination (effectively a null) at the vertex area, one of the aspects of the invention which enables enlarged sub reflector diameters without introducing corresponding signal blockage.

The shifting of the dish reflector illumination outward from the vertex area is demonstrated in solutions for exemplary 0.168 and 0.25 F/D deep dish reflectors and sub-reflector assemblies in FIGS. 10 and 11, respectively.

Notably with respect to FIG. 10, the exemplary embodiment has a maximum signal intensity that occurs at 66 degrees @ 22.4 GHz and 70 degrees @ both 18.7 and 28.5 GHz. Further, the dish reflector is illuminated with a signal intensity within 3 dB of the maximum signal intensity only within an angular range between 38 and 93 degrees. In contrast, the prior art assembly does not have an illumination drop-off greater than 3 dB from the peak, all the way to 0 degrees (the illumination peak is effectively proximate the vertex area).

Notably with respect to FIG. 11, the exemplary embodiment has a maximum signal intensity that occurs at 64 degrees @ 7.8 GHz and 65 degrees @ 6.525 GHz in the respective assemblies. Further, the dish reflector is illuminated with a signal intensity within 3 dB of the maximum signal intensity only within an angular range between 40 and 86 degrees. Here again, the prior art assembly has a peak illumination that is effectively the center of vertex area, an area that is shielded by the sub reflector.

One skilled in the art will appreciate that while additional shielding and/or radiation absorbing materials may be applied to assist with correction of the radiation pattern with respect to the vertex and/or sub-reflector spill-over regions, the reduction in these regions, along with the previously unobtainable 10 to 45 degree region radiation reduction has been obtained in the present example without any such additional structure. As this signal pattern improvement is made without absorbing the signal energy projected in unwanted directions by additional means, more of the signal energy is applied to the free space target, resulting in a 6% improved antenna efficiency measured by the inventor's software based models of the exemplary embodiment operating in the 22.4 Ghz microwave band.

Where each of the shoulders 55, steps 60 and grooves 35 formed along the outer diameter of the unitary dielectric block are provided radially inward, manufacture of the dielectric block may be simplified, reducing overall manufacturing costs. Dimensioning the periphery of the distal surface as normal to the a longitudinal axis of the assembly provides a ready manufacturing reference surface 85, further simplifying the dielectric block 10 manufacture process, for example by machining and/or injection molding.

From the foregoing, it will be apparent that the present invention brings to the art a sub-reflector assembly 1 for a reflector antenna with improved electrical performance and significant manufacturing cost efficiencies. The sub-reflector assembly 1 according to the invention is strong, lightweight and may be repeatedly cost efficiently manufactured with a very high level of precision.

Table of Parts

| | |
|---|---|
| 1 | sub-reflector assembly |
| 3 | waveguide |
| 5 | waveguide transition portion |
| 10 | dielectric block |
| 15 | sub-reflector |
| 20 | distal end |
| 25 | dielectric radiator portion |
| 30 | sub-reflector support portion |
| 35 | groove |
| 40 | distal groove |
| 45 | distal sidewall |
| 50 | dish reflector |
| 55 | shoulder |
| 60 | step |
| 65 | proximal end |
| 70 | proximal conical surface |
| 75 | distal conical surface |
| 80 | disk |
| 85 | reference surface |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A method for illuminating a dish reflector of a reflector antenna, comprising:

providing a dish reflector with a focal point;

providing a waveguide coupled to a vertex of the dish reflector at a proximal end;

providing a sub-reflector supported by a dielectric block coupled to a distal end of the waveguide;

the dielectric block provided with a dielectric radiator portion proximate the distal end of the waveguide;

passing an RF signal through the waveguide and the dielectric block to reflect from the sub-reflector through the dielectric block and at least partially through the dielectric radiator portion to the dish reflector;

the RF signal illuminating the dish reflector with a maximum signal intensity occurring at an angle of at least 64 degrees between a longitudinal axis of the waveguide and a line between a focal point of the dish reflector and the dish reflector.

2. The method of claim 1, wherein the dish reflector has a ratio of reflector focal length to reflector diameter that is less than or equal to 0.25.

3. The method of claim 1, wherein the ratio of reflector focal length to reflector diameter is less than or equal to 0.168.

4. The method of claim 1, wherein the dielectric radiator portion has a diameter that is greater than ⅗ of a diameter of the sub-reflector.

5. The method of claim 1, wherein a diameter of the sub-reflector is 2.5 wavelengths or more of a desired operating frequency.

6. The method of claim 1, wherein an outer diameter of the dielectric radiator portion is provided with a plurality of radial inward grooves, the radial inward grooves perpendicular to a longitudinal axis of the dielectric block.

7. The method of claim 1, wherein the dielectric radiator portion is generally cylindrical.

8. A method for illuminating a dish reflector of a reflector antenna, comprising:

providing a dish reflector;

providing a waveguide coupled to a vertex of the dish reflector at a proximal end;

providing a sub-reflector supported by a dielectric block coupled to a distal end of the waveguide;

the dielectric block provided with a dielectric radiator portion proximate the distal end of the waveguide;

passing an RF signal through the waveguide and the dielectric block to reflect from the sub-reflector through the dielectric block and at least partially through the dielectric radiator portion to the dish reflector;

the RF signal illuminating the dish reflector with a signal intensity within 3 dB of a maximum signal intensity only within an angular range between 38 and 93 degrees between a longitudinal axis of the waveguide and a line between a focal point of the dish reflector and the dish reflector.

9. The method of claim 8, wherein the dish reflector has a ratio of reflector focal length to reflector diameter that is less than or equal to 0.25.

10. The method of claim 8, wherein the ratio of reflector focal length to reflector diameter is less than or equal to 0.168.

11. The method of claim 8, wherein the dielectric radiator portion has a diameter that is greater than ⅗ of a diameter of the sub-reflector.

12. The method of claim 8, wherein a diameter of the sub-reflector is 2.5 wavelengths or more of a desired operating frequency.

13. The method of claim 8, wherein an outer diameter of the dielectric radiator portion is provided with a plurality of radial inward grooves, the radial inward grooves perpendicular to a longitudinal axis of the dielectric block.

14. The method of claim 8, wherein the dielectric radiator portion is generally cylindrical.

15. A method for illuminating a dish reflector of a reflector antenna, comprising:

providing a dish reflector;

providing a waveguide coupled to a vertex of the dish reflector at a proximal end;

providing a sub-reflector supported by a dielectric block coupled to a distal end of the waveguide;

the dielectric block provided with a dielectric radiator portion proximate the distal end of the waveguide;

passing an RF signal through the waveguide and the dielectric block to reflect from the sub-reflector through the dielectric block and at least partially through the dielectric radiator portion to the dish reflector;

the RF signal illuminating the dish reflector with a signal intensity within 3 dB of a maximum signal intensity only at an angle of greater than 38 degrees between a longitudinal axis of the waveguide and a line between a focal point of the dish reflector and the dish reflector.

16. The method of claim 15, wherein the dish reflector has a ratio of reflector focal length to reflector diameter that is less than or equal to 0.25.

17. The method of claim 15, wherein the ratio of reflector focal length to reflector diameter is less than or equal to 0.168.

18. The method of claim 15, wherein the dielectric radiator portion has a diameter that is greater than ⅗ of a diameter of the sub-reflector.

19. The method of claim 15, wherein an outer diameter of the dielectric radiator portion is provided with a plurality of radial inward grooves, the radial inward grooves perpendicular to a longitudinal axis of the dielectric block.

20. The method of claim 15, wherein the dielectric radiator portion is generally cylindrical.

* * * * *